United States Patent [19]

Lowe

[11] 4,394,834

[45] Jul. 26, 1983

[54] CAN CRUSHER

[76] Inventor: Richard D. Lowe, 3 West St., Windsor Locks, Conn. 06096

[21] Appl. No.: 282,670

[22] Filed: Jul. 13, 1981

[51] Int. Cl.[3] ..... B30B 9/32

[52] U.S. Cl. ..... 100/245; 100/280; 100/293; 100/902

[58] Field of Search ..... 100/902, 240, 245, 280, 100/283, 284, 285, 293, 218

[56] References Cited

U.S. PATENT DOCUMENTS

| | | | |
|---|---|---|---|
| 2,446,898 | 8/1948 | Alvarez | 100/902 |
| 3,780,647 | 12/1973 | Reimers | 100/902 |
| 3,889,587 | 6/1975 | Wharton | 100/902 |
| 4,088,072 | 5/1978 | Wittmeier | 100/902 |
| 4,143,595 | 3/1979 | Carlson | 100/902 |
| 4,301,722 | 11/1981 | Balbo | 100/902 |

*Primary Examiner*—Billy J. Wilhite

*Attorney, Agent, or Firm*—George G. Butenkoff

[57] ABSTRACT

A can crusher having continuous incremental crushing action for reducing cans or similar containers to a compact size is disclosed. The crusher consists of a housing having a cylindrical configuration with a cylindrical cavity disposed therein enclosed at one end by a mounting fixture for horizontal attachment to a wall or the like and enclosed at the other end by a front plug which provides a crushing surface. Disposed within the cylindrical cavity is a ram slidably engageable therein having ratchet arms attached in a spaced-apart relationship thereto adapted for attachment to a handle for propelling the ram through the cavity in a continuous incremental manner toward the front plug. The housing includes a can insertion opening disposed in a top portion thereof for enabling a can to be inserted into the cavity between the ram and the plug and a can ejection slot disposed in the bottom portion thereof proximate the front plug for passing a can which has been crushed out of the housing. A handle pivotally attached to the front portion of the housing is connected to the ratchet arms. The ratchet arms have notches disposed therein in a spaced-apart relationship to pivot pins on a pivot plate fixedly attached to the handle wherein said pivot pins are adapted for engagement with said notches for continuously driving the ram toward the front plug crushing a can or the like therebetween as the handle is rotated in a counterclockwise direction. After crushing the can, rotation of the handle in a clockwise direction releases the pressure on the can which is then ejected by gravity from the housing through the can ejection slot.

13 Claims, 6 Drawing Figures

CAN CRUSHER

DESCRIPTION

1. Technical Field

This invention relates to an apparatus for crushing containers and more particularly to a device suited for crushing metal cans with manual operation.

2. Background Art

Recently several states have enacted anti-pollution laws requiring a deposit to be made by the consumer on metal cans such as beer cans, soda cans and the like thereby ensuring that such cans would not be discarded but would be returned to appropriate stores for a refund of the deposit. These laws were usually enacted in conjunction with anti-litter campaigns by the various states. The return of empty beer cans, soda cans, and the like to various stores has resulted in a considerable handling and storage problem, the cans occupying a considerable volume. Since the cans are not utilized for refills, but are either recycled or discarded in appropriate disposal points, the crushing of cans to substantially minimize the volume of storage is desirable for both the storekeeper and for the consumer who stores the cans at home prior to bringing them back to the store for a refund. Over the years many can crusher structures have been proposed for compacting cans. Some apply a force transverse to the axis of the can, some apply a force along the axis of the can while others supply a force askewed from the axis of the can. The prior art discloses both continuous and incremental application of forces to crush the cans. Most prior art devices are adapted for being mounted in a vertical position requiring that after the crushing action is completed the crushed can can be physically removed from the apparatus.

Can crushers particularly suited for manual operations are illustrated by Alvarez in U.S. Pat. No. 2,446,898; Wharton in U.S. Pat. No. 3,889,587; Carlson in U.S. Pat. No. 4,143,595 and in Wittmeier in U.S. Pat. No. 4,088,072. None of these devices show or suggest the can crusher presented herein.

It is the general purpose of this invention to provide a can crusher having a simple design with sufficient mechanical advantage to enable an operator to crush a can or the like and eject said can from the apparatus with a minimal amount of effort.

DISCLOSURE OF INVENTION

A preferred embodiment of the can crusher comprises a housing having a tubular configuration with a base end and a front end all symmetrically disposed about a centerline axis, a mounting bracket attached at the base end of the housing for attaching the can crusher to a wall or the like, a front plug fixedly disposed within the housing at the front end thereof having a back surface thereon for providing a crushing surface, a ram having a cylindrical configuration disposed within the housing and slidably engageable therein having a front surface in a variable spaced-apart relationship to the front plug and together with the housing and the front plug define a can cavity therebetween, a pair of ratchet arms disposed in a spaced-apart relationship to one another with the housing positioned therebetween, means for attaching the ratchet arms to the ram, a pair of pivot plates disposed in a spaced-apart relationship to one another proximate the front end of the housing, means for rotatably attaching the pivot plates to the housing, handle means attached to the pivot plates for rotating said pivot plates about a rotation axis, means for engaging the ratchet arms for providing movement of the ram toward or away from the front plug as the handle is rotated in a counterclockwise or clockwise direction respectively, means for inserting a can into the can cavity and means for removing a crushed can from the can cavity.

A primary feature of the present invention is a pair of pivot pins disposed in a spaced relationship on each of the pivot plates. Additionally the pivot plates are held in the spaced-apart relationship by rigid pins passing through and rotatably positioned within the housing symmetrically about the rotation axis. The pivot pins, having an isosceles triangular relationship to rigid pin ends passing through the pivot plates, are adapted for incremental engagement in notches within the ratchet arms as the pivot plates are rotated for propelling the ram toward the crushing surface. A further feature of the present invention is the horizontal mounting of the apparatus on a wall or the like with a can ejection slot disposed within the bottom portion of the housing proximate the back surface of the front plug for passing a crushed can out of the housing upon retraction of the ram. Additionally the cylindrical housing provides guide means for translating the ram within the housing and containment means for minimizing the dimensions of the crushed can.

A primary advantage of the present invention is the continuous incremental advancement of the ram toward the front plug for crushing a can therebetween while rotating the handle from a first position to a second position. Incremental engagement of the pivot pins with the notches enables the can crusher to have relatively small dimensions while maintaining sufficient mechanical advantage to crush the can with minimum amount of effort. Additionally the can ejection slot located in the bottom portion of the housing allows the can, after crushing, to fall by gravity from the housing into a storage container or the like positioned below the housing. The continuous rotation of the handle in a clockwise direction from a full compression position to a first position enables the operator to quickly reload the can crusher to repeat the operation.

The foregoing and other objects, features and advantages of the present invention will become more apparent in the light of the following detailed description of a preferred embodiment thereof as shown in the accompanying drawing.

BEST MODE FOR CARRYING OUT THE INVENTION

Figure 1:
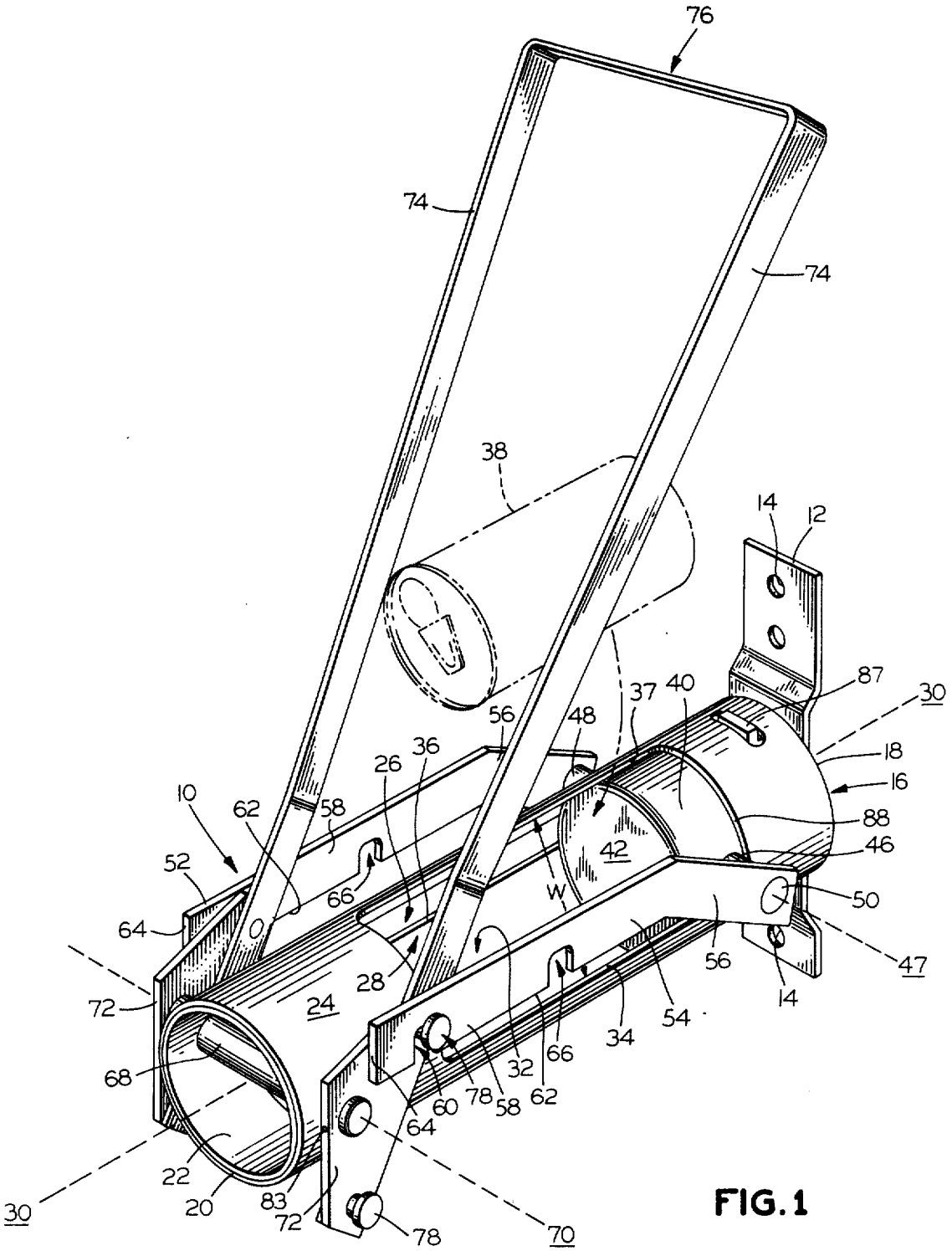
FIG. 1 is a perspective view of the can crusher of the present invention positioned to receive a can for crushing by rotating the handle in a counterclockwise direction.

Referring now to the drawing and more particularly to FIG. 1 which shows a simplified perspective view of the can crusher 10 positioned horizontally for attachment to a wall in accordance with a preferred embodiment of the present invention. The can crusher includes a mounting bracket 12 having bolt holes 14 disposed therein adapted for accommodating bolts, screws or the like for attaching the mounting bracket to a wall (shown in phantom in FIG. 4) or other suitable structure and a housing 16, having a tubular configuration, attached at its base end 18 to the mounting bracket 12 with its front end 20 sealed by a front plug 22 as more fully shown in FIG. 5. The housing has a cylindrical wall 24 with a guide slot 26 axially disposed therein and extending therethrough to a can cavity 28. The guide slot has an elongated configuration with a length substantially longer than a circumferential width and is disposed within the wall 24 in a spaced-apart parallel relationship with a centerline axis 30 passing axially through the housing, said housing is symmetrically disposed about the centerline axis. A can insertion opening 32, having a length substantially equal to the length of the guide slot and in register therewith, is disposed within the cylindrical wall and extends therethrough in a radially spaced-apart relationship to the guide slot, is defined on one side by a first guide lip 34 radially positioned in the cylindrical wall diametrically opposite a second guide lip 36 defining the bottom perimeter of the guide slot and on the other radial side by a second lip 37 disposed in a substantially parallel circumferentially spaced-apart relation to the first guide lip and defining the width of the opening. The can insertion opening 32 has a width W sufficient to allow a can 38 shown in phantom to pass therethrough into the can cavity 28. Disposed within the can cavity is a ram 40 having a cylindrical configuration with a diameter less than the inside diameter of the cylindrical wall and having a front surface 42 disposed in a substantially perpendicular relationship to the centerline axis 30. The ram is adapted for movement within the can cavity along the centerline axis from a first fully opened position proximate the mounting bracket to enable the can 38 to be disposed within the can cavity to a fully compressed position proximate the front plug 22. The can cavity is defined by the front surface of the ram, the cylindrical wall and a back surface 44 of the front plug as more fully shown in FIG. 5. The insertion opening having a circumferential width less than one-half of the diameter of the housing serves to guide the ram concentrically within the housing.

The ram 40 includes a first rigid pin 46 rotatably extending therethrough symmetrically about a first radial centerline axis 47 disposed in a perpendicular relationship to the centerline axis 30 having a first end 48 extending through and slidably engageable within the guide slot 26 and a second end 50 extending through the can insertion opening 32 in slidable contact with the first guide lip 34 defining one side of the can insertion opening such that as the ram moves along the centerline axis within the housing the first and second end of the first rigid pin are supported and guided by the first and second guide lips 34, 36 respectively. A first ratchet arm 52 is attached at one end to the first end 48 of the rigid pin 46 and a second ratchet arm 54 is attached at one end to the second end 50 of the rigid pin. The first and second ratchet arms 52, 54 respectively, each have a first portion 56, attached at one end to the first and second end of the first rigid pin 48, 50 respectively, angularly disposed in a spaced-apart relation to the centerline axis 30 and extending substantially to the top of the housing in a direction toward the front end 20 of said housing and a second portion 58 integral with the first portion and extending from the first portion toward the front end of the housing substantially along the top of said housing in a substantially parallel spaced-apart relationship with the centerline axis. The first and second ratchet arms include first notch 60 disposed on the bottom surface 62 of the first and second ratchet arms approximate the end surface 64 of the second portions 58 and a second notch 66 disposed on the bottom surface 62 intermediate the first notch and the first portion of ratchet arms in a spaced-apart relationship to the first notch 60.

A second rigid pin 68 rotatably positioned through the housing approximate the front end, having a rotation axis 70 perpendicularly disposed to and preferably passing through the centerline axis 30, extends through the front plug and the cylindrical wall 24 on both sides of the housing thereby securing the front plug within the housing. Disposed on each end of the second rigid pin, external the housing are pivot plates 72 with the housing substantially spanning the space therebetween. Each pivot plate is fixedly attached to legs 74 of a handle 76 and has a pair of pivot pins 78 disposed in an isosceles triangular spaced-apart relationship to the rotation axis 70 passing through the second rigid pin 68. The pivot pins 78, as more fully shown in FIG. 2, include a first cylinder 80, having a diameter less than the width of the first and second notches 60, 66, extending from the pivot plate a distance at least greater than the thickness of the ratchet arms 52, 54 respectively to a cap 82 having a diameter greater than the diameter of the first cylinder and greater than the width of the first and second notches. As shown in FIG. 1 the first and second notches on the first and second ratchet arms extend sufficiently into said arms to enable the pivot pins 78 to be securely engaged within the first or second notches respectively such that rotation of the handle 76 about the rotation axis 70 of the second rigid pin results in an axial translation of the first and second ratchet arms in a direction toward the front end of the housing thereby translating the ram 40, which is fixedly attached to the ratchet arms, toward the front end of the housing. The second rigid pin 68 is fixedly attached to the pivot plate 72 with pins 83 or the like such that as the handle 76 and the pivot plate 72 are rotated, the second rigid pin 68 rotates about the rotation axis 70 thereby changing the separation between the ram 40 and the front plug 22.

Figure 2:
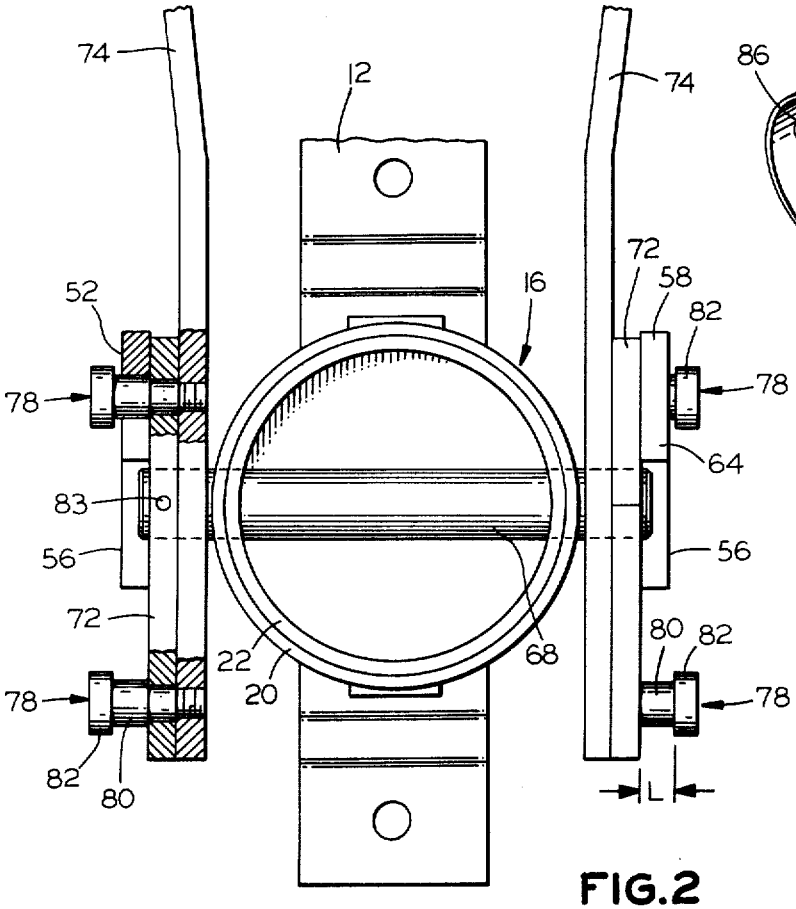
FIG. 2 is a front end view of the can crusher in the A—A direction as shown in FIG. 1.
Figure 3:
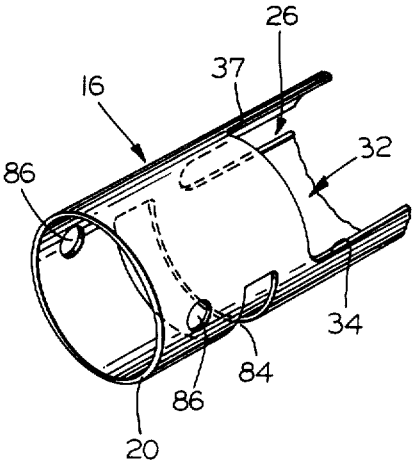
FIG. 3 is a partial cutaway perspective view of the front end of the cylindrical housing shown in FIG. 1.
Figure 4:
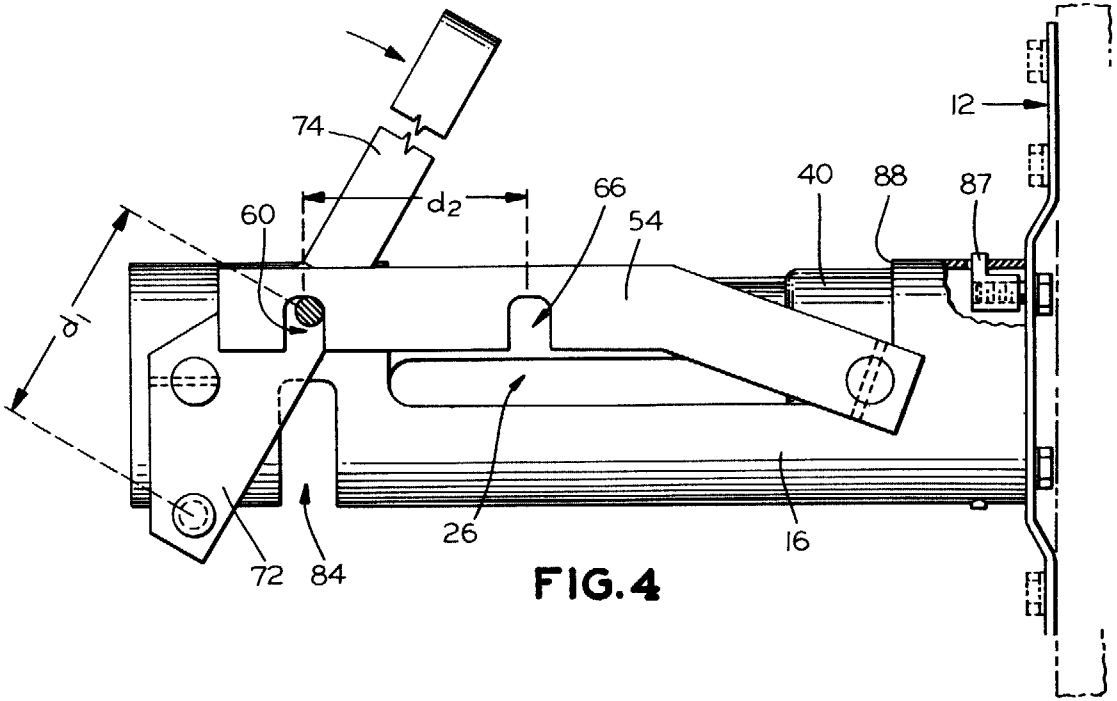
FIG. 4 is a simplified side view of the can crusher attached to a wall with its handle in a first position as shown in FIG. 1 for receiving a can.

Referring now to FIG. 3 which is a simplified cutaway perspective partial view of the front portion of the housing 16 showing the positional relationship of the guide slot 26, the can insertion opening 32 and a can ejection slot 84 disposed in the bottom portion of the cylindrical wall. The circular openings 86, diametrically oppose one another within the cylindrical wall 24 proximate the front end 20, position the second rigid pin 68, as shown in FIG. 2, within the housing. As shown in FIG. 1 and in the cutaway view of FIG. 4 the housing may be fixedly attached to the mounting bracket with attachment means 87 well known in the art or may be attached by welding or the like. It is to be recognized that the housing, the mounting bracket, and the front plug or any combination thereof, could be fabricated as a unitary structure by means well known in the art. The pivot pins 78 are separated from one another a distance $d_1$ which is substantially equal to the separation $d_2$ between the first and second notches 60, 66 respectively as shown in FIG. 4 with a sufficient clearance for runout.

Figure 6:
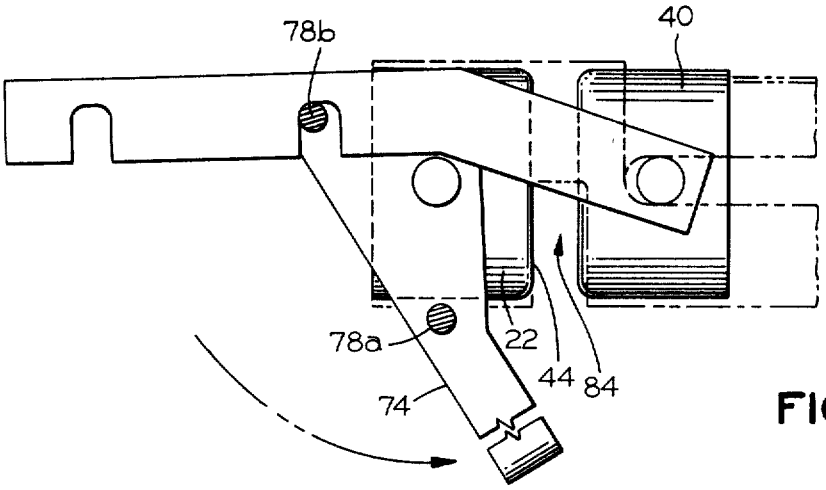
FIG. 6 is a simplified partial side view of the front end of the can crusher with the handle and ram in the full compression position.
Figure 5:
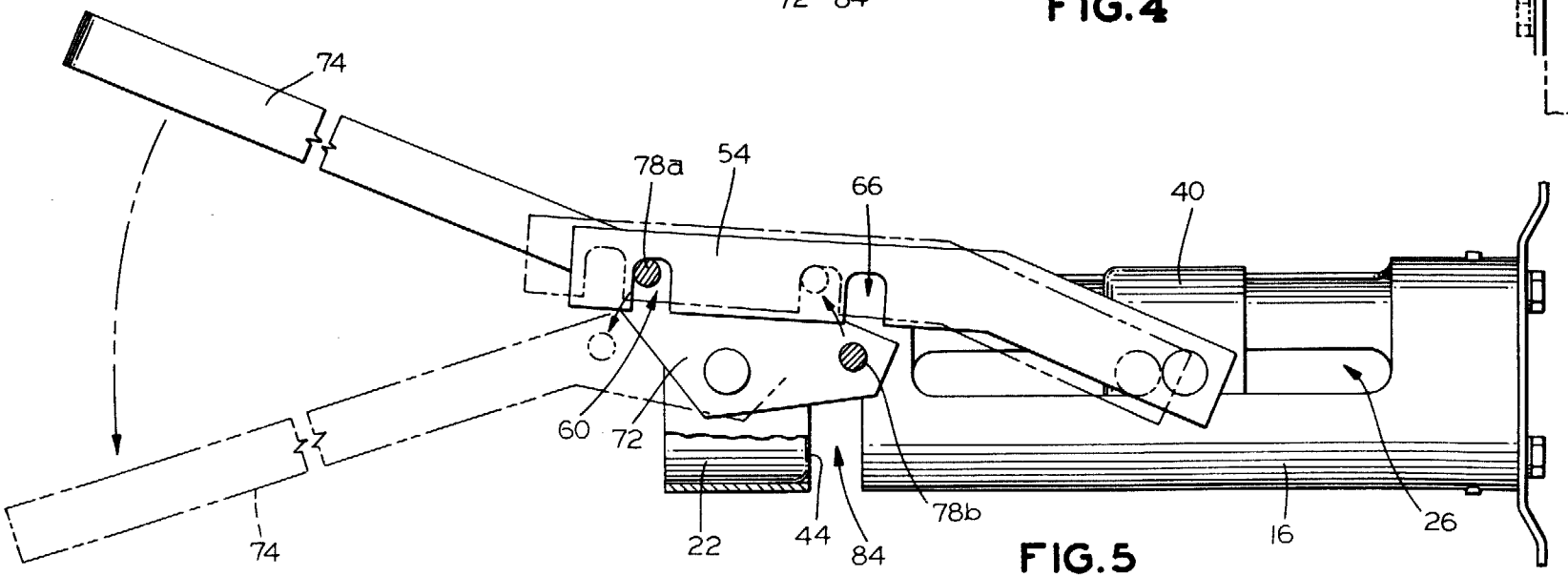
FIG. 5 is a simplified side view of the can crusher with the handle and ram shown in a second position and with the handle and ram shown in phantom in a third position showing the interrelationship of the pivots with the notches.

Refer now to FIGS. 1, 4, 5 and 6. In operation, the handle 76 is positioned above the housing in its extreme clockwise position with the first notch 60 engaged with one pivot pin such that the first rigid pin 46 passing through the ram 40 rests against the back surface 88 of the can insertion opening thereby positioning the ram 40 in a first position. The back surface of the can insertion opening provides a convenient stop to enable the handle 76 to remain in an upright position. The can 38 is inserted into the can insertion opening 32 and the handle 76 is rotated in the counterclockwise direction as shown in FIG. 5. As the handle rotates the first pivot pin 78*a* engaged with the first notch 60 is translated in a direction away from the mounting bracket causing the ratchet arms and the ram 40 fixedly attached thereto to be translated through the housing toward the front plug thereby decreasing the space therebetween and causing the can to be crushed between the ram and the back surface 44 of the front plug. As the handle 76 is rotated proximate the centerline axis 30 through the housing, the pivot plate 72 rotates such that the second pivot pin 78*b* begins to engage with the second notch 66. As the handle is continued to be rotated through the centerline axis 30 the first pivot pin 78*a* disengages from the first notch 60 and the second pivot pin 78*b* becomes fully engaged within the second notch 66 as shown in the phantom lines in FIG. 5. During this process of rotating the handle, the ram 40 continues in the direction toward the front plug within the housing further crushing the can therebetween. As shown in FIG. 6 when the handle is rotated to its extreme counterclockwise position the ram 40 is positioned juxtaposed the back surface 44 of the front plug with the can crushed therebetween. Upon rotating the handle in the clockwise direction the process of engaging the pivot pins with the notches reverses and the ram moves away from the end plug thereby releasing pressure on the crushed can and the crushed can falls by gravity through the can ejection slot 84 out of the can crusher. Upon rotation of the handle in the clockwise direction to its extreme clockwise position the ram is projected back to its original position proximate the back surface 88 of the can insertion opening and the process may be repeated.

It is to be recognized that the can crusher may be fabricated with a plurality of pivot pins and a corresponding plurality of notches within the ratchet arm. The utilization of a plurality of pivot pins and notches to propel the ratchet arm in the forward direction to crush a can enables the can crusher to be fabricated in a relatively small size of simplistic design while having a sufficient mechanical advantage to crush cans with the minimal amount of force applied on behalf of the user. It is also to be recognized that the pivot plate and the ratchet arms may be rotatably attached to doles or the like which are fixedly attached to the ram and housing.

Although the invention has been shown and described with respect to a preferred embodiment thereof it should be understood by those skilled in the art that other various changes and omissions in the form and detail thereof may be made therein without departing from the spirit and scope of the invention.

I claim:

1. A can crusher comprising:

a housing having a tubular configuration with a base end and a front end, all symmetrically disposed about a centerline axis;

mounting means for attaching the can crusher to a support means;

a front plug fixedly disposed within the housing symmetrically about the centerline axis at the front end, having a back surface for providing a crushing surface;

a ram, having a cylindrical configuration, disposed within the housing and slidably engageable therein having a front surface in a variable spaced-apart relationship to the front plug and together with the housing and the front plug define a can cavity therebetween;

guide means for guiding the ram along the centerline axis toward and away from the front plug;

a pair of ratchet arms disposed in a spaced-apart relationship to one another with the housing positioned therebetween;

means for attaching the ratchet arms to the ram;

a pair of pivot plates disposed in a spaced-apart relationship to one another proximate the front end of the housing;

means for rotatably attaching the pivot plates to the housing;

handle means attached to the pivot plates for rotating the pivot plates about a rotation axis;

means for engaging the ratchet arms for providing movement of the ram toward or away from the front plug as the handle is rotated in a counterclockwise or clockwise direction respectively;

said housing having a first opening therein for inserting a can into the can cavity; and a second opening in said housing for removing a crushed can from the can cavity.

2. The invention in accordance with claim 1 wherein the guide means is a guide slot axially disposed in a cylindrical wall of the housing and extending therethrough.

3. The invention in accordance with claim 2 wherein said first opening is a can insertion opening in a cylindrical wall of the housing disposed in a radially spaced-apart relationship to the guide slot.

4. The invention in accordance with claim 3 wherein the guide slot has an elongated configuration with a length substantially longer than a circumferential width and the can insertion opening has a length substantially equal to the length of the guide slot.

5. The invention in accordance with claim 4 wherein the can insertion opening is defined on one side by a first guide lip radially positioned in the cylindrical wall diametrically opposite a second guide lip defining a bottom perimeter of the guide slot.

6. The invention in accordance with claim 1 wherein the means for attaching the can crusher to a support means is a mounting bracket attached to a base end of the housing adapted for horizontally attaching the can crusher to said support means.

7. The invention in accordance with claim 1 wherein the means for engaging the ratchet arms includes a plurality of notches disposed in a bottom side of said ratchet arms and a plurality of pivot pins disposed in a spaced-apart relationship on the pivot plates for successive engagement in the plurality of notches.

8. The invention in accordance with claim 1 wherein the means for engaging the ratchet arms includes a pair of spaced-apart notches disposed in a bottom side of said ratchet arms and a pair of pivot pins disposed in a spaced-apart relationship on the pivot plates for successive engagement in the notches.

9. The invention in accordance with claim 8 wherein the pair of pivot pins are disposed in an isosceles triangular relationship to the rotation axis.

10. The invention in accordance with claim 1 wherein the means for rotatably attaching the pivot plates to the housing is a rigid pin passing through the housing proximate the front end and symmetrically disposed about the rotation axis wherein each pivot plate is fixedly attached at the ends of the rigid pin wherein said rigid pin is rotatably positioned within said housing.

11. The invention in accordance with claim 2 further including a first rigid pin disposed substantially orthogonal to the centerline axis and passing through the ram wherein one end of said first rigid pin extends through the guide slot and the second end extends through a can insertion opening, wherein the boundaries of said guide slot and can insertion opening are adapted for providing support surfaces for said first rigid pin.

12. The invention in accordance with claim 1 wherein said second opening for removing a crushed can from the can cavity is a can ejection slot disposed within a cylindrical wall of the housing proximate the back surface of the front plug wherein said can ejection slot has a length partially encircling the bottom portion of the circumference of the cylindrical wall of the housing.

13. The invention in accordance with claim 12 wherein the mounting means for attaching the can crusher to a support means is a bracket attached to the base end of said housing adapted for attaching said can crusher in a horizontal relationship wherein the can ejection slot is positioned to enable the crushed can to fall therethrough by gravity.

* * * * *